United States Patent [19]

Cartee et al.

[11] Patent Number: 4,890,847

[45] Date of Patent: Jan. 2, 1990

[54] TARGET RETRIEVAL SYSTEM

[75] Inventors: Larry A. Cartee; Harry A. Barot, both of Schaumburg, Ill.

[73] Assignee: Detroit Armor Corporation, Schaumburg, Ill.

[21] Appl. No.: 144,417

[22] Filed: Jan. 14, 1988

[51] Int. Cl.[4] ..... F41J 7/02

[52] U.S. Cl. ..... 273/406

[58] Field of Search ..... 379/454; 24/128 R, 128 R; 273/406, 408, 369

[56] References Cited

U.S. PATENT DOCUMENTS

| | | | |
|---|---|---|---|
| 2,293,251 | 8/1942 | Fords | 24/128 R |
| 2,793,038 | 5/1957 | Wallace et al. | 273/406 |
| 2,838,309 | 6/1958 | Merz et al. | 273/406 |
| 4,249,743 | 2/1981 | Lee | 273/408 |
| 4,349,706 | 9/1982 | Thompson | 379/454 |

FOREIGN PATENT DOCUMENTS

| | | | |
|---|---|---|---|
| 2304052 | 12/1976 | France | 273/406 |
| 469962 | 4/1969 | Sweden | 273/406 |

OTHER PUBLICATIONS

Johannsen "Automatic Electric Trolley Target System" (two pages), date unknown.

Spieth "Elektrische Luftgewehr-Anlage 10m" (two pages) data unknown.

Spieth "Luftpistole" (one page), data unknown.

L-W Star "Target Moving Device" (two pages), data unknown, Polytronic-ABA "TG-190 Air Weapons System" (one page), data unknown.

*Primary Examiner*—Edward M. Coven

*Assistant Examiner*—Benjamin Layno

*Attorney, Agent, or Firm*—Lee, Mann, Smith, McWilliams & Sweeney

[57] ABSTRACT

A system for retrieval and replacement of targets which may be easily and quickly installed through self-locking mounting means for a drive unit and a target trap assembly as well as a snap-in arrangement for mounting trolley cables, a drive cord and a target carriage. A bullet trap assembly permits installation of its mounting bracket free of the bullet trap itself and provides for expeditious insertion and removal of the bullet trap for cleaning. The system includes battery-powered means for indoor and outdoor use, and provision is made for alternative connection to an external electrical power source, whereby the target carriage is driven away very rapidly between retrieved and target positions and the carriage may be stopped almost instantly in any desired position. Driving of the target carriage by the drive cord is accomplished through a center-mounted drive pulley which avoids side load, drive cord canting and cable run-off problems encountered with prior art target retrieval systems.

15 Claims, 2 Drawing Sheets

96
24
112
103
102
72
102
110
100
104
56
128
130
88
76
88
62
116
128
136
26
125
116
92
110
98
90
70
136
22
118
28
124
114
58
30
126
125
120
118
28
20
32
52
54
48
60
61
68
64

22
46
32
48
69
56
40
3.
30
42
134
34
63
51
62
36
42
38
44
50
38
54
48
52
58
60
61
3.
68
64

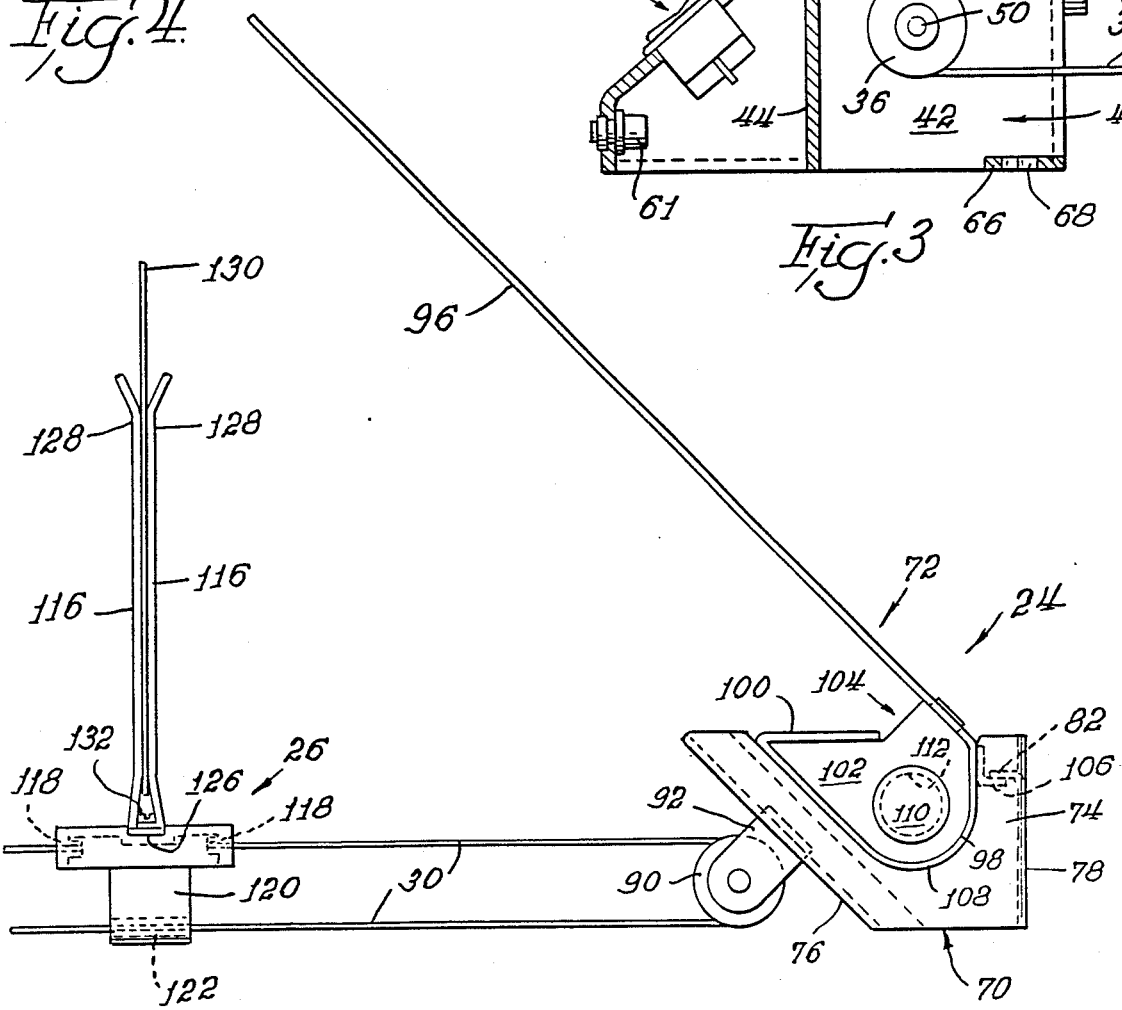
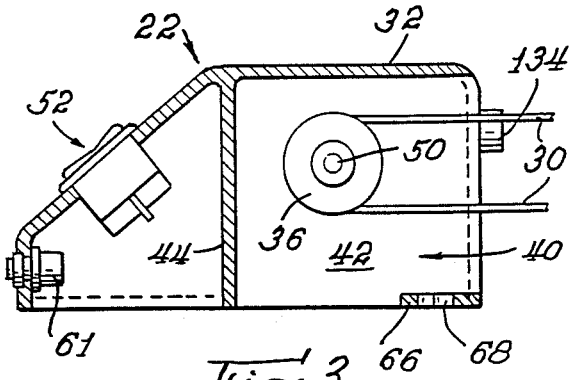
Fig. 3
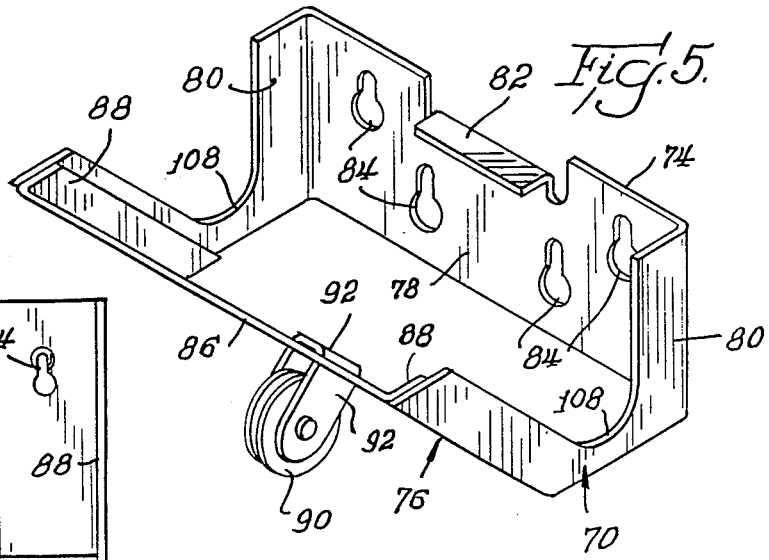
Fig. 5
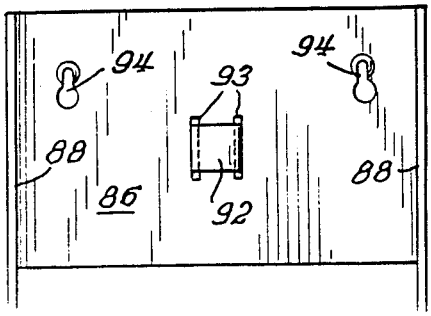
Fig. 6

TARGET RETRIEVAL SYSTEM

BACKGROUND OF THE INVENTION

This invention relates to systems for retrieval and replacement of targets used with air guns and firearms, and particularly to a powered system for fast, safe and easy retrieval of targets on demand of the shooter. The target retrieval system of this invention is particularly well suited for use with air rifles and pistols but may be readily adapted for use with firearms.

In target shooting and marksmanship competition a target is ordinarily inspected and replaced after a selected number of rounds have been fired by one shooter. The used target is inspected by the shooter and others for scoring, instructional comment and out of natural curiosity.

Although used targets may be inspected without retrieval through the use of binoculars, this is not as satisfactory as close inspection and does not accomplish replacement of the target.

Manual retrieval and replacement of targets by persons who walk from the firing line to the target, or by a person adjacent the target, has long been customary. This method of retrieval and replacement takes considerable time, however, and disrupts the shooting sequence. In addition, manual retrieval can be dangerous, particularly where more than one shooter is engaged on the range.

PRIOR ART RETRIEVAL SYSTEMS

Mechanical target retrieval systems have been in use for a number of years, particularly in Europe. Earlier mechanical retrieval systems were manually operated. More recently power operated systems have come into use.

Mechanical systems for retrieval of targets commonly employ a target disposed on a target carriage which is mechanically movable between a remote target position and the firing line. Upon completion of firing the shooter operates the retrieval system to mechanically move the target carriage and target from the target position to the firing line where the target may be inspected and replaced. The carriage with the new target is then mechanically moved to the target position for the next firing sequence. Such systems employ either a manual or a power drive mechanism activated at the firing line for selectively moving the target carriage between the firing line and the target position.

A typical prior art manually operated target retrieval system for use with air rifles and pistols is the TG-190 Air Weapons Systems of Polytronic-ABA, a European company. The TG-190 target retrieval system employs a manual cable drive mechanism including a hand crank connected to a drive pulley for manually transporting a target carriage on a pair of trolley cables stretched between the drive mechanism at the firing line and a bullet deflector and trap located at a remote target position. With a target positioned on the carriage at the target position the shooter fires an air rifle or pistol at the target. After a selected number of shots he manually operates the hand crank to move the target carriage back to a position adjacent the drive mechanism where the used target may be inspected and replaced by a new target. The shooter may then again mechanically operate the hand crank to move the target carriage back to the remote target position for additional firing. The Polytronic cable drive mechanism employs a pulley arrangement which provides a mechanical advantage so that the target carriage may be quickly moved between the target position and the firing line as the shooter operates the hand crank.

A prior art power operated target retrieval system is marketed by another European company, Hans Johanssen Maschinenfabric und Apparatebau KG. The Johanssen Automatic Electric Trolley Target System is marketed for air rifle or air pistol target shooting on a 10 meter range. The system includes an electric drive mechanism located at the firing line and a bullet deflector and trap at the remote target position. Trolley cables are stretched between the drive mechanism and the bullet trap, and a target carriage is shiftably mounted on the cables. The target carriage is connected to a looped drive cable which is stretched between a drive pulley mounted on one side of the drive mechanism and an idler pulley secured to the bullet trap. A two-directional electric motor drives the side-mounted drive pulley to cause the target carriage to be moved on the trolley cables between the target position immediately in front of the bullet trap and a retrieved position adjacent the drive mechanism. A two-position electric switch on the drive mechanism permits the shooter to selectively actuate the motor to rotate the drive pulley and move the target carriage in either direction. Electric power is supplied to the drive motor through an electrical cord connected to a utility company service outlet.

Another power operated target retrieval system of the prior art is that of Ernst K. Spieth GmbH of West Germany. The drive mechanism of the Spieth system also employs a side-mounted drive pulley driven by a two-directional electric motor which must be connected by an electric cable to a utility company service outlet. The Spieth system also employs a target carriage movably mounted on trolley cables stretched between the drive mechanism and a remote bullet deflector and trap, as well as a looped drive cable stretched between the drive pulley at the drive mechanism and an idler pulley at the bullet trap. The power driven target retrieval system of Spieth is generally similar to and operates in a manner similar to the Johanssen system.

A third prior art power operated target system is marketed by L-W Star, also a European company. The L-W Star Target Moving Device is intended for use with an air rifle, an air pistol or a cross bow on a 10 meter target range. The components of the L-W Star power retrieval system are similar to those of the Johanssen and Spieth power operated systems. L-W Star also employs a side-mounted drive pulley driven by a two-directional electric motor which must be plugged into an electrical service outlet. The L-W Star system operates in the same general fashion as the Johanssen and Spieth systems.

SUMMARY OF THE INVENTION

The power operated target retrieval system of the present invention provides a number of improvements over target retrieval systems of the prior art. In common with prior art systems it employs a power drive unit to be located at the firing line and a bullet deflector and trap to be located at a remote target position. A target is replaceably disposed on a target carriage which is movably mounted on a pair of trolley cables stretched between the power mechanism and the bullet trap.

The drive unit of the target retrieval system utilizes a high-speed, two-directional electric motor which is mounted in a one-piece molded plastic housing. The electric drive motor is mounted to one side in the housing and drives a drive pulley which is centrally mounted in the housing. The drive motor is a low voltage type which is adapted to be powered by a set of electric storage batteries mounted in the housing on the opposite side of the drive pulley from the drive motor. Alternatively, when a utility company electrical service outlet is conveniently available, the drive motor may be powered by a "battery eliminator" which includes an electrical cord connected through a transformer for plugging into the service outlet, thus providing an external power source.

A drive cord or cable is connected to the target carriage and is looped around and stretched between the drive pulley and a remote idler pulley secured to the bullet trap. The drive permits high-speed shifting of the target carriage and target between the remote target position immediately in front of the bullet trap and a retrieved position adjacent the drive mechanism. The drive arrangement is such that the target carriage is transported between the two positions in only a few seconds. This permits fast checking of shooting results and rapid replacement of the target.

Because of the center mounting of the drive pulley the drive cord puts no side load on the drive unit or the target carriage, and there is no canting of the cord and no danger of cable run-off, thus avoiding problems which are encountered in power driven target retrieval systems of the prior art. The speed and safety of operation are substantially enhanced as the result of the centrally mounted drive pulley.

The bullet trap of this invention employs a metallic deflector plate mounted at approximately a 45 degree angle to the line of fire, with an integral bullet trap formed at the bottom edge portion of the plate. The bullet trap is removably engaged in a mounting bracket, which bracket is adapted to be secured to a fixed object adjacent the target position. This is accomplished through an angle fixedly secured to the back of the bullet trap, which angle is adapted to engage an integral tab formed on the mounting bracket to support the deflector plate in the shooting position at 45 degrees to the line of fire. The weight of the deflector plate causes the angle to bear against the tab of the mounting bracket to support the bullet trap in the bracket in shooting position. The bullet trap may be readily removed from the mounting bracket by rotating the deflector to disengage the angle from the tab to permit the trap to be lifted from the bracket. Removable plugs are employed at the opposite ends of the bullet trap to assist in ease of cleaning of the trap when removed from the mounting bracket.

The mounting bracket employs keyhole type apertures on its rear side for ready engagement with and disengagement from headed studs, screws or nails which are secured to a stationary object adjacent the target position.

This construction and arrangement of the bullet trap and its mounting bracket provides a modular system for quick mounting and demounting of the mounting bracket separate from the bullet trap itself. Once the mounting bracket is secured at the desired position the bullet trap may then be readily mounted in the bracket and subsequently readily removed from the bracket for cleaning.

The one-piece molded housing for the drive is open on the bottom for expeditious assembly of the center-mounted drive pulley, the motor and the batteries. The arrangement also permits ready replacement of the batteries when necessary. A two-position rocker switch for controlling the direction of electrical current to the motor has its operating button extending outwardly of the housing in a location to permit easy manipulation by the shooter. The molded housing is formed with keyhole apertures formed in integral horizontal webs to permit easy mounting and demounting of the drive unit on headed vertical studs, screws or nails secured on a horizontal mounting surface of a stationary object located at the firing line.

Each of the trolley cables is provided with an attachement button secured at each end and adapted to be removably secured in respective keyhole apertures in the drive unit housing at one end and in the mounting bracket for the bullet trap at the other end. The arrangement is such that the attachment buttons of the two trolley cables may be readily snapped into and out of the respective keyhole apertures for a quick assembly and disassembly of the retrieval systgem. The trolley cables are of a length such that when stretched taut the target carriage and target will be placed at the proper distance from the drive unit to provide the desired range, such as five meters, ten meters or fifteen meters.

BRIEF DESCRIPTION OF THE DRAWINGS

FIG. 3 is an orthogonal side sectional view of the drive unit taken generally along line 3—3 of FIG. 2;

FIG. 4 is a side elevational view of the bullet trap and mounting bracket assembly, with the target carriage and a target located at the target position;

FIG. 5 is a perspective view of the mounting bracket for the bullet trap; and FIG. 6 is an elevational view of the back side of the front portion of the mounting bracket.

DETAILED DESCRIPTION OF THE INVENTION

Figure 1:
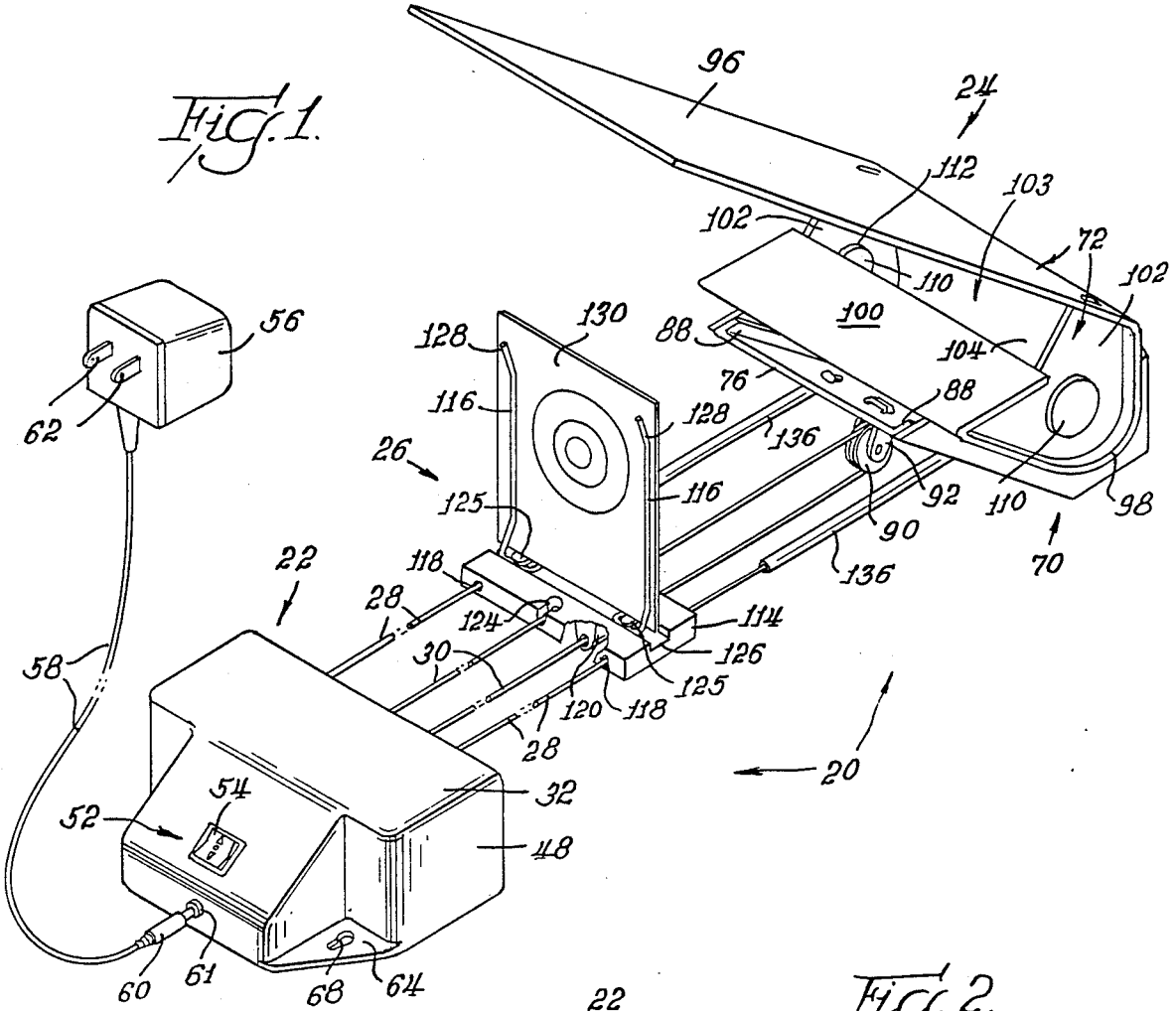
FIG. 1 is a perspective view of the target retrieval system of this invention, with the trolley cables and the drive cord foreshortened.

The target retrieval system of the invention is illustrated in FIG. 1, with the entire system generally designated by the reference numeral 20. The system includes three major components, a power drive unit 22, a bullet trap assembly 24, and a target carriage 26. The target carriage is shiftably mounted on a pair of horizontally spaced, parallel trolley cables 28 which are secured to and stretched tautly between the drive unit 22 and the bullet trap assembly 24 when the retrieval system is positioned for use with the drive unit located at the firing line and the bullet trap assembly located at the remote target position. In a manner to be explained in more detail, selective power operated shifting of the target carriage, between a retrieved position adjacent the drive unit 22 and a target position immediately in front of the bullet trap assembly 24, is accomplished through a looped drive cable or cord 30 stretched tautly between the drive unit and the bullet trap and selectively powered by the drive unit 22.

Drive Unit

Figure 2:
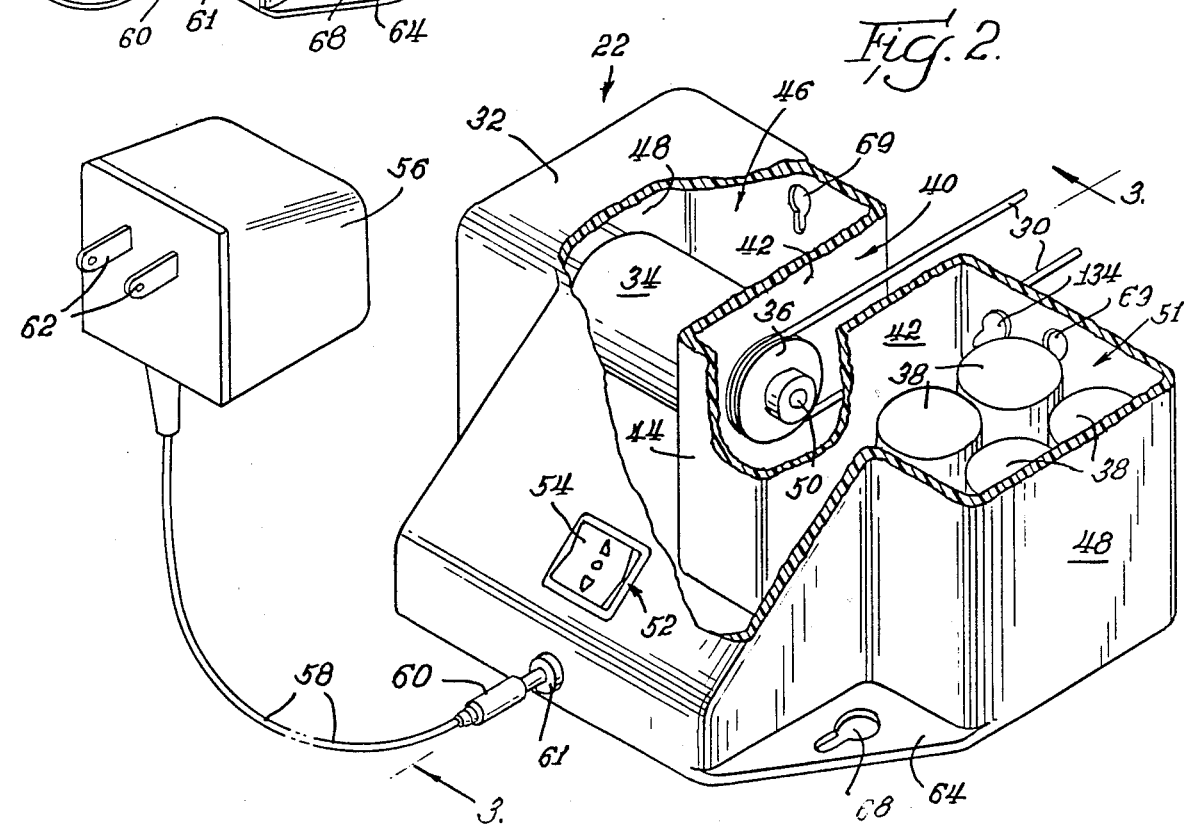
FIG. 2 is a perspective view of the drive unit of the target retrieval system with a portion of the housing broken away to illustrate the positioning of the drive motor, the drive pulley, and the batteries.

As may be best understood by reference to FIG. 2, the drive unit 22 includes a one-piece molded plastic housing 32 in which are mounted an electric drive motor 34, a centrally located drive pulley 36, and one or more electric storage batteries 38, four in the embodiment illustrated.

The plastic housing 32 is preferably molded as a single piece from an impact resistant plastic such as ABS. ABS is used in the embodiment illustrated because it is strong and stable and acts as an electrical insulator. Also, ABS will not corrode or deteriorate if the housing should become wet when the target system is used outdoors. The housing is open at the bottom, as best seen in FIG. 3, in order to permit expeditious mounting of the electric motor 34, the drive pulley 36, the batteries 38 and other components. The open bottom of the housing also facilitates replacement of the batteries 38 when required.

To provide for center mounting of the drive pulley 36 a central drive well 40 is formed by a pair of side walls 42 and a back wall 44 which are integrally molded as portions of the plastic housing 32. As will be understood by reference to FIGS. 1 and 2, the drive well 40 is open to and faces the bullet trap assembly 24 when the target system 20 is assembled for use.

The electric motor 34 is mounted in a motor compartment 46 to one side of the central drive well 40. The motor compartment is formed between one of the side walls 42 of the central drive well and one of the outer side walls 48 of the housing. Suitable mounting means for the motor are provided (not shown) for fixedly mounting the motor with one end of its drive shaft 50 operatively extending through the adjacent side wall 42 into the central drive well 40. The drive pulley 36 is fixedly secured to the end of the drive shaft 50 within the drive well in a position to be centrally located in the drive unit 22.

The batteries 38 are mounted in a battery compartment 51 which is formed between the side wall 42 and the outer side wall 48 on the opposite side of the center drive well 40 from the motor compartment 46. Suitable mounting means are provided (not shown) to hold the batteries in fixed positions while still permitting ready replacement when necessary.

When the drive cord 30 is stretched tautly between the drive unit 22 and the bullet trap assembly 24, it is tightly looped about the drive pulley 36 as shown in FIG. 2. This provides that the drive cord will be driven in one direction or the other depending upon the direction in which the drive pulley is rotated by the drive motor 34. As will be described in more detail, the arrangement is such that rotation of the drive pulley in a counterclockwise direction as seen in FIG. 2 drives the drive cord 30 to move the target carriage 26 toward the drive unit 22, and rotation of the drive pulley in a clockwise direction drives the drive cord to move the target carriage toward the bullet trap assembly 24.

The drive motor 34 is a low voltage type adapted for two-directional, high-speed drive from electrical power supplied by the batteries 38. A motor suitable for this purpose is a conventional six volt direct current motor with sufficient drive speed, acceleration and deceleration to drive the target carriage 26, through the drive pulley 36 and the associated drive cord 30, to cause the target carriage to be moved from the target position to the retrieved position, and vice versa, in only a few seconds when the retrieval system 20 is set up for use. Four "D" cell batteries 38 for supplying electrical energy to the motor are suitable to accomplish this performance.

Electrical current flow to the motor 34 is controlled by a two-position rocker switch assembly 52 which is mounted in the slanted rear wall of the housing 32, convenient to a shooter located at the firing line. The switch assembly is electrically connected by conventional wiring (not shown) to the batteries and to the motor. The switch assembly 52 includes a two-position, self-centering rocker button 54 which, when not being manipulated, is resiliently biased to a central, neutral location where the switch cuts off current flow to the drive motor. When the swich button 54 is depressed in a direction toward the target carriage, the switch assembly provides current flow from the batteries 38 to the motor 34 to cause the drive pulley 36 to rotate in a clockwise direction as seen in FIGS. 2 and 3; this causes the target carriage 26 to be driven toward the target position. When the rocker button 54 is depressed in the opposite direction, current flow from the batteries to the motor is reversed and the motor rotates the drive pulley in the counterclockwise direction as seen in FIGS. 2 and 3; this causes the target carriage to be driven toward the retrieved position. When the switch button is released, it immediately moves to its neutral location and rotation of the drive pulley stops almost instantly. Thus, by selective manipulation of the switch button the target carriage may be caused to stop at any selected position from the retrieved position to the target position.

In order to provide an alternative external electrical power source, a "battery eliminator" is provided. The battery eliminator includes a transformer and rectifier 56 connected to an electrical cord 58, which cord is connected to suitable wiring (not shown) in the interior of the housing 32 through a conventional coaxial plug 60 which may be plugged through a suitable female receptacle 61 provided in the bottom portion of the wall of the housing as seen in FIGS. 2 and 3. The transformer 56 is of a step-down type which also converts alternating current to direct current. It is provided with connector prongs 62 adapted for being plugged into a conventional electric outlet supplied with alternating current from an electric utility company. In the embodiment illustrated the transformer 56 receives 110 to 120 volt alternating current and converts this to six volt direct current suitable for the driven motor 34. Electrical conductors (not shown) of the electrical cord 58 are connected in a conventional manner to the electrical wiring within the power unit 22. When plugged into an electrical outlet the battery eliminator transformer 56 provides an alternative external power source for operation of the power unit.

A unique, self-locking mounting arrangement is provided for securing the drive unit 22 in position for use. The housing 32 is formed with two external webs 64 (one shown in FIG. 2) and a central internal web 66 (FIG. 3), each being formed integrally with the housing at spaced positions along the bottom margin. Each of the webs 64 and 66 is formed with a keyhole attachment aperture 68 adapted to engage with a headed attachment stud or the like (not shown). In order to permit the drive unit to be removably secured to a stationary object (not shown) located at the firing line such attachment studs are secured on a horizontal surface of the stationary object in the same pattern as the housing attachment apertures. The head of each of the studs is raised sufficiently above the surface of the stationary object to permit the head to be fitted through an enlarged portion of the respective keyhole aperture 68. The housing 32 may then be shifted toward the target position where the shank of each stud is then disposed in a narrow portion of the aperture where the head cannot pass through. This permits the drive unit 22 to be firmly locked in a stationary position for use as part of the target retrieval system 20. Tension in the trolley cables 28 and in the drive cord 30 will bias the drive unit 22 toward the bullet trap assembly 24 to cause the drive unit to be firmly retained in place by reason of engagement of the studs in the keyhole apertures 68. The keyhole apertures also permit easy disengagement of the drive unit 22 for storing or transport to a different location. Disengagement is accomplished by moving the housing 32 in a direction away from the bullet trap to permit the studs to be disengaged from the keyhole apertures so that the drive unit may then be lifted from the horizontal surface.

For attachment of the trolley cables 28 to the drive unit 22 the housing is provided with two horizontally spaced keyhole apertures 69 (FIG. 2) formed in the wall of housing 32. The spacing of the cable attachment apertures 69 conforms to the desired spacing of the trolley cables 28; a spacing of approximately four inches is suitable, for example. Each keyhole aperture is adapted to receive an attachment button (not shown) secured at one end of each of the trolley cables 28. For this purpose each keyhole aperture 69 is formed with an enlarged upper portion and a narrower lower portion so that the attachment buttons may be snapped into the larger portions and then moved downwardly where they are retained with the cables extending through the narrower portions. The trolley cables may be detached for storage or transport to a different location by moving the attachment buttons upwardly where they can be removed from the larger portions of the keyhole apertures 69.

Bullet Trap Assembly

The bullet trap assembly 24 includes two principal components, a bullet trap mounting bracket 70 and a combined deflector and bullet trap 72 (best seen in FIGS. 1, 4 and 5).

The bullet trap mounting bracket 70 is formed from two sheet metal components, an attachment component 74 and a pulley component 76, which are fixably secured to one another by spot welding, for example. The attachment component 74 is generally U-shaped, comprising a central web 78 and a pair of side webs 80 bent at 90° to the central web.

The bullet trap assembly is also provided with a unique self-locking mounting arrangement. The central web is formed with a horizontal, integral tab 82 bent inwardly at a right angle to the central web, which tab supports the bullet trap 72 in a manner to be described. Keyhole mounting apertures 84, here four in number, are formed in the central web 78, each of which has a lower enlarged portion and an upper narrow portion. The keyhole apertures are adapted to receive suitable headed attachment studs or the like (not shown), which studs are secured on a vertical portion of a stationary object such as a post, a tree, etc. (not shown) in the same pattern as the keyhole apertures. The heads of the attachment studs are so sized and sufficiently spaced from the stationary object that they may be inserted into the enlarged portions of the keyhole apertures 84. The mounting bracket may then be moved downwardly so that the shanks of the studs are disposed in the narrow portions of the keyhole apertures with the heads trapped so that the mounting bracket 70 is removably secured to the stationary object. The mounting bracket may be readily disengaged for storage with other components of the target retrieval system or for transport to a different location by upward movement of the bracket to permit the heads of the attachment studs to be slipped out of the enlarged portions of the keyhole apertures 84.

The pulley component 76 of the mounting bracket 70 comprises a central web 86 and opposed integral attachment flanges 88 bent at 90° to the central web. When the attachment flanges 88 are welded to the distal edge portions of the side webs 88 of the attachment component 74, the central web 86 is disposed at approximately 45° to the horizontal so that stray bullets will be deflected downwardly to prevent ricochet toward the shooter. An idler pulley 90 is rotatably attached between the arms of a U-shaped pulley bracket 92 which has its bight portion fixedly secured to a central location of the central web 86, such as by spot welding. To guard against loosening of the welds and to prevent the pulley bracket from being separated from the mounting bracket, the bight of the pulley bracket is located on the inside of the mounting bracket and the arms of the pulley bracket extend through respective slots 93 formed in the mounting bracket (FIG. 6); thus, the major force exerted on the pulley bracket 92 by the pulley 90 and the drive cord 30 is carried by the bight of the pulley bracket bearing against an integral web of metal of the mounting bracket between the slots 93.

In order to permit attachment of the target trap ends of the trolley cables 28, a pair of spaced keyhole apertures 94 is formed in the central web 86. The cable attachment apertures 94 are spaced horizontally to conform to the spacing of the cable attachment apertures of the drive unit 22. Enlarged lower portions of the keyhole apertures are adapted to pass attachment buttons (not shown) secured at the ends of the trolley cables, while narrower upper portions of the keyhole apertures retain the cables with the attachment buttons trapped behing the central web when the trolley cables are in tension. The attachment buttons are identical to the attachment buttons secured at the opposite end of each cable so that either end of each cable may be attached to either the drive unit 22 or the target trap assembly 24. The trolley cables may be readily disengaged for storage or for transport to a different location by moving the attachment buttons so that they may pass through the enlarged portions in the keyhole apertures.

The combined deflector and bullet trap 72 may be formed of the same sheet metal as the mounting bracket 70. The bullet trap includes a deflector plate component 96 and an integral bullet trap component 98. The bullet trap component 98 is generally trough-shaped as shown and is integrally formed at the bottom edge portion of the deflector plate. An integral retainer flange 100 is formed along the distal edge of the bullet trap component, the flange being bent at an acute angle in order to be disposed horizontally when the bullet trap assembly 24 is in position for use. End closure plates 102 are secured at the opposite side edge portions of the bullet trap component to form a well 103 which is closed except for a narrow slot 104 for receiving spent bullets and particulate, which are then trapped in the well. The closure plates 102 are formed with short integral tabs (not shown) which are inserted into conforming slots (not shown) formed in the bullet trap component 98 adjacent each side edge; after the tabs are disposed in the respective slots, they are spot welded to the bullet trap component to permanently secure the closure plates in position.

In order to removably support the bullet trap 72 in the bullet trap mounting bracket 70, an elongated retainer angle 106 (FIG. 4) has one leg fixedly secured, as by spot welding, to the back side of the bullet trap component 98 with a free leg extending outwardly in a horizontal direction when the deflector plate 96 is disposed at 45° to the horizontal. Retainer cutouts 108 are formed at each of the side webs 80 of the mounting bracket 70; the cutouts 108 are of a shape to conform to the outer surface of the bullet trap component 98 when the combined deflector and bullet trap 72 are assembled as shown in FIGS. 1 and 4. Assembly is accomplished by fitting the bullet trap component 98 into the retainer cutouts 108 while the deflector plate 96 is generally in a vertical position. The deflector plate is then rotated counterclockwise to its 45° position as shown in FIG. 4, at which position the free leg of the retainer angle 106 engages the underside of the supporting tab 82 of the mounting bracket 70. The bullet trap is removably retained in this assembled position by gravity.

As will be understood by those skilled in the art, the bullet trap assembly 24 with its 45° deflector plate is intended for use with deformable bullets, such as lead pellets which upon impact tend to "slide" down the deflector to the bullet trap well, as distinguished from rigid BBs which tend to bounce.

In order to permit ready disposal of spent bullets and particulate from the bullet trap well 103 removable plugs 110 are snapped into place in respective clean-out apertures 112 formed in the end closure plates 102. To dispose of spent bullets and other debris the bullet trap 72 is first removed from the mounting bracket by rotating the deflector plate 96 toward the vertical to disengage the retainer angle 106 from the supporting tab 82 so that the bullet trap may be moved upwardly out of the mounting bracket. Next, one or both plugs 110 are removed and spent bullets and particulate are dumped from one or both of the clean-out apertures 112.

The Target Carriage

The target carriage 26 includes a carriage slide portion 114 and a pair of target retainer arms 116.

The slide portion 114 is preferably formed of a rigid plastic which is shatterproof but which will not cause ricochet if struck by a stray bullet. Molded polycarbonate plastic has been found to be satisfactory for this purpose. The slide portion is formed with two aligned pairs of cylindrical apertures 118, one pair at each edge portion of the slide, with the sizes and spacing being arranged to slidably receive the respective trolley cables 28 when the trolley cables are strectched taut with their mounting buttons retained in the cable attachment apertures 69 in the drive unit housing 32 and in the cable attachment apertures 94 in the bullet trap mounting bracket 70. The slide portion 114 includes an integral guide projection 120 which extends downwardly from the central portion of the slide portion. An elongated cylindrical guide aperture 122 is formed in the distal end portion of the guide projection 120. The guide aperture 122 is positioned to slidably receive the bottom strand of the drive cord 30 when the drive cord is looped about the drive pulley 36 of the drive unit 22 and about the idler pulley 90 of the bullet trap 24, and the drive cord is pulled taut. To secure the upper strand of the looped drive cord 30 to the target carriage 26 keyhole attachment apertures 124 (one shown) are formed on opposite sides of the central portion of the carriage slide 114. Retainer buttons (not shown) are secured at the opposite ends of the looped drive cord. The retainer buttons are so sized that they may be inserted through enlarged portions of the keyhole apertures but will not pass through narrow slot portions of the apertures. Thus, the retainer buttons are retained in the keyhole retainer apertures to removably secure the opposite ends of the drive cord 30 to opposite sides of the drive carriage 26 when the drive cord is pulled taut as shown in FIG. 1.

The target retainers 116 are formed of spring wire with bottom bight portions 125 shiftably retained in a retainer slot 126 formed across the top of the carriage slide portion 114 perpendicular to the trolley cables 28 and the drive cord 30. Each of the target retainers has a pair of elongated, upwardly extending arms 128 which bear resiliently against the opposite side edge portions of a paper target 130 which is inserted between them (FIG. 4). The target retainers 116 may be shifted inwardly or outwardly in the retainer slot 126 to accommodate different sizes of targets. The target retainers are locked in place by retainer screws 132 which are slidably inserted through the bight portions 125 and are threadably received in vertical threaded holes (not shown) formed in the slide portion 114. The threaded holes are formed at spaced positions along the slot 126 such that the target retainers 116 may be secured at proper positions to retain targets 130 of varying sizes.

In order to absorb the shock load encountered when the target carriage 26 bumps the drive unit 22 or the bullet trap assembly 24, a pair of resilient bumpers 134 is provided at the drive unit, and a pair of resilient bumpers 136 is provided at the bullet trap assembly. The bumpers 134 and 136 are made of a resilient material such as rubber or rubber-like plastic. As shown in FIG. 3, the bumpers 134 are short cylindrical members with integral attachment portions secured in apertures (not shown) in the face of the drive unit housing 32 and located to be engaged by the slide portion 114 of the target carriage. As shown in FIG. 1, the bumpers 136 are elongated tubular members slipped over the trolley cables and bearing against the attachment bracket 70 of the bullet trap assembly; the bumpers 136 are of a length to adequately space the target and the target carriage and to locate the target at the proper range from the firing line.

Installation, Operation and Summary

The target retrieval system 20 of this invention may be easily and quickly installed at any suitable location, indoors or outdoors.

For example, installation at a shooting range is accomplished by mounting the drive unit 22 at the firing line and the target trap assembly 24 at the remote target position on previously located mounting studs provided at these positions; while specially designed mounting studs may be utilized, headed screws or nails which are properly sized and placed will serve as well. As previously described in more detail, the heads of the mounting studs are received in the larger portions of the respective keyhole mounting apertures of the drive unit and the bullet trap. The drive unit and the bullet trap are then shifted into their final positions where they are locked in place by the heads of the studs which are trapped by the narrower portions of the keyhole apertures. When the drive unit 22 and the bullet trap assembly 24 are secured, the preassembled trolley cables 28 and target carriage 26 may be readily installed by snapping the attachment buttons of the cables into the respective cable attachment apertures in the drive unit and the bullet trap. Alternatively, one or the other of the bullet trap or the drive unit may be first secured in place, the trolley cables snapped into place and then the other unit secured at a position determined by the length of the trolley cables. Once the target carriage and the trolley cables are locked in place, the drive cord may be looped around the drive pulley and the idler pulley and snapped into the cable attachment apertures in the target carriage. If desired, the trolley cables and the drive cable may be adjusted in length by repositioning the attachment buttons.

It will be understood that the target retrieval system 20 is not limited to use at a formal shooting range but may be easily set up in a field or in a building, for example in a recreation room or a basement of a dwelling. In the event of installation of the system at other than a shooting range, appropriately spaced mounting studs or the like are secured to stationary objects located at a chosen firing line and a chosen target position, and the installation proceeds as explained previously.

Once the drive unit, the target trap, the target carriage, the trolley cables and the drive cord are properly placed and secured, the target retrieval system is ready for use. With the target carriage 26 in the retrieved position adjacent the drive unit 22 a target of the desired size is inserted between the spring arms 128 of the target retainers 116; if necessary, the target retainers may be shifted toward or away from one another to properly fit the chosen target. The rocker switch button 54 of the drive unit is then depressed toward the bullet trap assembly 24 and held until the target carriage 26 reaches the target position. A shooter at the firing line then fires the desired number of bullets at the target.

Upon completion of the round of firing the shooter depresses the rocker switch button 54 in the opposite direction and holds it in the depressed position until the drive unit 22 has caused the target carriage to be moved from the target position to the retrieved position. The used target is then removed and inspected and a new target inserted in place, and the rocker switch button is again depressed toward the bullet trap to move the target carriage and new target to the target position for another round of firing.

The operative elements of the target retrieval system 20 are so designed that no damage will be done in the event the rocker switch button 54 is not released before the target carriage engages the resilient bumpers at the drive unit or at the bullet trap.

It will be understood from the previous description that the target retrieval system of this invention is advantageously battery powered for indoor or outdoor use. In addition, provision is made for plugging the drive unit into an external electrical power source for alternative drive.

The target retrieval system is conveniently light and compact. The entire system when disassembled may be readily stored in a single container.

The unique, self-locking mounting arrangement for the drive unit 22 and for the target trap assembly 24, and the advantageous snap-in assembly arrangement for the trolley cables 28 and target carriage 26 and for the drive cord 30 are important in providing for simple and rapid installation of the target retrieval system. By reason of the unique positive, self-locking mounting and snap-in arrangement, assembly and disassembly may be quickly and easily accomplished. The target retrieval system is essentially foolproof.

In operation the target carriage moves very rapidly between retrieved and target positions, requiring only a few seconds to traverse the range. Furthermore, the target carriage may be stopped almost instantly at any desired position.

The center-mounted drive pulley of the drive unit avoids side load, drive cord canting and cable run-off problems which are encountered with prior art target retrieval systems employing side-mounted drive pulleys.

The modular concept of the target retrieval system is particularly advantageous, leading to simplicity of manufacture, installation and use. The unique, self-locking mounting means for the drive unit and the target trap assembly as well as the snap-in arrangement for mounting the trolley cables, the drive cord and the target carriage contribute importantly to the modular concept. Also important is the modular arrangement of the bullet trap assembly which permits the bullet trap mounting bracket to be installed free of the bullet trap itself. The unique mounting arrangement for the bullet trap in its mounting bracket provides for expeditious insertion and removal of the bullet trap, an additional important contribution to the modular concept of the invention.

Although the embodiment of the target retrieval system described herein is especially well adapted for use with air guns, the system may be readily adapted for use with firearms simply by increasing the gauge of the metal of the deflector and bullet trap to accommodate the particular firearms and ammunition to be used.

Variations and modifications may be effected without departing from the scope of the novel concepts of the present invention.

We claim:

1. In a system for placement and retrieval of targets and including a power drive unit for location at a firing line, a bullet trap assembly for location at a remote target position, and a target carriage shiftably disposed on trolley cables between the power drive unit and the bullet trap assembly and arranged for being driven by the power drive unit between the firing line and the target position, a modular arrangement for removably installing the drive unit, the trap assembly, and the trolley cables and target carriage, comprising;

(a) self-locking mounting means for removably securing said drive unit and said target trap assembly at the firing line and the target position, respectively, said mounting means including one or more keyhole apertures formed in the drive unit and oriented to engage with respective headed studs at the firing line whereby tension force exerted by said trolley cables biases the drive unit toward the bullet trap assembly to secure the drive unit at the firing line, and (b) attachment means for detachably securing the trolley cables to the drive unit and the trap assembly.

2. The modular arrangement of claim 1 in which said attachment means includes a cable snap-in arrangement at both the drive unit and the trap assembly for detachably securing the trolley cables.

3. The modular arrangement of claim 1 in which said self-locking mounting means comprises;

(a) a plurality of headed studs fixably secured in a first predetermined pattern on a first attachment surface located at the firing line, (b) a plurality of said keyhole apertures formed in the drive unit in a pattern corresponding to said first pattern and adapted for receiving said headed studs for removably securing said drive unit on said first attachment surface;

(c) A plurality of headed studs fixably secured in a second predetermined pattern on a second attachment surface located at the target position, and (d) a plurality of said keyhole apertures formed in the trap assembly in a pattern corresponding to said second pattern and adapted for receiving said headed studs for removably securing said trap assembly on said second attachment surface.

4. The modular arrangement of claim 3 in which each of said keyhole apertures includes an enlarged portion of a size for receiving the head of one of said studs and a narrower portion which will not allow passage of said head, whereby said drive unit and said trap assembly may be removably secured by passing the heads of said studs through said enlarged portions and shifting the respective drive unit and trap assembly toward the narrower portions of the keyhole apertures to lock the drive unit and the trap assembly on the studs.

5. The modular arrangement of claim 3 in which said keyhole apertures formed on said drive unit and on said trap assembly each includes a first portion sufficiently large to receive the head of a stud and second portion too narrow to pass the head, whereby said drive unit and said trap assembly may be removably secured on said first and second attachment surfaces by inserting the heads of said studs through said first portions and shifting the respective drive unit and trap assembly to trap the heads behind said second portions.

6. In a system for placement and retrieval of gun targets and including a power drive unit for location at a firing line, a bullet trap assembly for location at a remote target position, and a target carriage shiftably disposed on trolley cables between the power drive unit and the bullet trap assembly and arranged for being driven by the power drive unit between the firing line and the target position, the improvement comprising:

(a) a drive pulley operatively mounted in said power drive unit and substantially centered with respect to the sides of said unit, (b) an idler pulley secured to said bullet trap assembly, and (c) a drive cable drivingly looped between said drive pulley and said idler pulley and secured to said target carriage, whereby rotation of said drive pulley exerts a force on said drive cable to shift said target carriage and whereby the load on said power drive unit is centered as the result of the centered mounting of said drive pulley.

7. The system according to claim 6 in which the power drive unit comprises:

(a) an electric motor drivingly secured to said drive pulley, (b) battery means adapted for providing electrical energy for driving said electric motor when connected to said motor, and (c) switch means connected between said electric motor and said battery means for selectively connecting the battery means to the electric motor to drive the electric motor.

8. The system according to claim 7 in which alternative means are provided for driving said electric motor from electrical power energy by an electrical power company.

9. The system according to claim 7 in which said electric motor is arranged for being driven in forward and reverse directions and said switch means includes an actuator which when moved in one direction causes the electric motor to be driven in the forward direction and when moved in another direction causes the electric motor to be driven in the reverse direction.

10. The system according to claim 6 including:

(a) self-locking mounting means for removably securing said drive unit and said target trap assembly at the firing line and the target position, respectively, and (b) attachment means for detachably securing the trolley cables to the drive unit and the trap assembly.

11. The modular arrangement of claim 10 in which said attachment means includes a cable snap-in arrangement at both the drive unit and the trap assembly for detachably securing the trolley cables.

12. The modular arrangement of claim 10 in which said self-locking mounting means includes a plurality of headed studs arranged for being detachably locked into respective attachment apertures formed in both the drive unit and the trap assembly.

13. The modular arrangement of claim 12 in which each of said keyhole apertures includes an enlarged portion of a size for receiving the head of one of said studs and a narrower portion which will not allow passage of said head, whereby said drive unit and said trap assembly may be removably secured by passing the heads of said studs through said enlarged portions and shifting the respective drive unit and trap assembly toward the narrower portions of the keyhole apertures to lock the drive unit and the trap assembly on the studs.

14. The modular arrangement of claim 13 in which said attachment apertures formed on said drive unit and on said trap assembly each includes a first portion sufficiently large to receive the head of a stud and a second portion too narrow to pass the head, whereby said drive unit and said trap assembly may be removably secured on said first and second attachment surfaces by inserting the heads of said studs through said first portions and shifting the respective drive unit and trap assembly to trap the heads behind said second portions.

15. The modular arrangement of claim 10 in which said self-locking mounting means comprises;

(a) a plurality of headed studs fixedly secured in a first predetermined pattern on a first attachment surface located at the firing line, (b) a plurality of attachment apertures formed in the drive unit in a pattern corresponding to said first pattern and adapted for receiving said headed studs for removably securing said drive unit on said first attachment surface;

(c) A plurality of headed studs fixedly secured in a second predetermined pattern on a second attachment surface located at the target position, and (d) a plurality of attachment apertures formed in the trap assembly in a pattern corresponding to said second pattern and adapted for receiving said headed studs for removably securing said trap assembly on said second attachment surface.

* * * * *